US005799797A

United States Patent [19]

Braun

[11] Patent Number: 5,799,797

[45] Date of Patent: Sep. 1, 1998

[54] CORNER POST CONSTRUCTION

[75] Inventor: Richard G. Braun, Churchville, Pa.

[73] Assignee: Stone Container Corporation, Chicago, Ill.

[21] Appl. No.: 773,445

[22] Filed: Dec. 26, 1996

[51] Int. Cl.[6] ..... B65D 81/02

[52] U.S. Cl. ..... 206/586; 206/453

[58] Field of Search ..... 206/523, 586, 206/453, 587, 813

[56] References Cited

U.S. PATENT DOCUMENTS

| | | | |
|---|---|---|---|
| 2,556,529 | 6/1951 | Farrell | 206/586 |
| 4,865,201 | 9/1989 | Liebel | 206/586 |
| 4,883,179 | 11/1989 | Dionne | 206/586 |
| 5,181,611 | 1/1993 | Liebel | 206/453 |
| 5,466,211 | 11/1995 | Komarek et al. | 493/355 |

*Primary Examiner*—David T. Fidei
*Attorney, Agent, or Firm*—Dick and Harris

[57] ABSTRACT

A corner post construction for containers, such as boxes and cartons, which may be fabricated from materials such as corrugated paperboard material. The corner post construction is provided by fabricating a substantially planar sheet of material, having a longitudinal axis, and bending the sheet of material along a fold line which is substantially parallel to the longitudinal axis, so that there are two corner post wings formed, with an included angle formed between them. A corner post reinforcing and retaining material is disposed along the fold line which maintains the corner post wings in substantially fixed angular relation to one another. Corner posts constructed according to the present invention can be affixed to the outside of a unit comprising one or more containers, or merely positioned within an enclosing container, to provide longitudinal support for increased stacking strength, and for enhanced resistance to vertical and lateral crushing at the corners of the container.

16 Claims, 1 Drawing Sheet

CORNER POST CONSTRUCTION

BACKGROUND OF THE INVENTION

1. Field of the Invention

The present invention relates to box and carton apparatus, in particular, box and carton apparatus which are fabricated from relatively light weight materials, such as cardboard, fiberboard and corrugated paperboard.

2. The Prior Art

Conventional containers which are fabricated from materials such as cardboard, fiberboard or corrugated paperboard, such as boxes and cartons which have generally rectangular cross-sectional configurations, are often required to contain and support heavy loads and be capable of withstanding substantial longitudinally-directed forces, such as those associated with having numerous like-filled boxes or cartons stacked on top of them.

In such conventional containers, the vertical walls often may not have sufficient load strength to permit stacking of multiple containers. When such stacking is desired, to provide the necessary stacking strength, either the individual wall thickness or the number of layers of wall material must be increased. Either alternative results in an increased usage of container material, which results in substantially increased materials and manufacturing cost, and also increases the weight of the container, increasing shipping costs as well.

As an alternative to increasing the thickness or number of layers making up the vertical walls of a container, it has been discovered that by providing vertical reinforcement of the corner regions, a substantial increase in the vertical loading strength, and collaterally, the side loading strength, of a container, can be achieved. Typical conventional corner post constructions involve modifications to the overall container blank, so that portions of the blank, upon articulation, produce integrally formed corner posts, which may have cross-sectional plans in a variety of configurations (rectangular, triangular, etc.). Such integrally formed corner posts, while providing enhanced stacking strength, etc., also typically require substantial increases in the amount of container material put into each blank, and require more complex cutting dies and/or cutting procedures, and more complex erecting apparatus and procedures, again increasing the cost and effort associated with each individual container.

Another corner post construction is angleboard, which are rigid, "L"-shaped members which are formed, preferably by extrusion, from a slurry of pulverized paper pulp, resin, glue, etc. Some plastic material may be included. Angleboard corner posts are strong, but may sometimes be brittle, as well as being more expensive to produce than many other corner post constructions. Angleboard corner posts also have a very high density, and can add significantly to the weight and cost of shipping of the overall container. In addition, angleboard material is more difficult to recycle than regular cardboard or corrugated paperboard.

Other known corner post constructions involve the laminating of two or more layers of material, which may or may not be folded along substantially parallel fold lines so as to have "L"-shaped cross-sectional configurations, and placing layers of adhesive between them, so that when the adhesive hardens, the two or more layers are locked into the "L"-shape. The individual corner posts are then placed into the corners of the container (which, as stated previously, typically has a rectangular configuration), and either affixed in place to the inside surfaces of the container, or not, as the particular application may require. Such laminated corner post constructions likewise often provide ample increase in strength, but again at the typical cost of increased material usage and weight.

It would be desirable to provide a corner post construction for containers which is capable of significantly increasing the stacking strength (among other characteristics) of a container, such as a box or carton fabricated from cardboard, fiberboard and corrugated paperboard, which has a substantially reduced material requirement, relative to prior art corner post constructions.

It would further be desirable to provide an improved corner post construction for containers which is relatively lightweight as compared to prior art corner post constructions.

It would also be desirable to provide an improved corner post construction for containers, which has a simplified construction and reduced cost.

It would further be desirable to provide an improved corner post construction which is also more readily recycled than prior art corner post constructions.

These and other objects of the invention will become apparent in light of the present specification including claims, and drawings.

SUMMARY OF THE INVENTION

The present invention comprises, in part, an apparatus for providing facilitated support for one or more containers, along a longitudinal direction thereof. The apparatus comprises a sheet of material, having a longitudinal axis. The sheet of material is folded, along at least one fold line extending substantially parallel to the longitudinal axis of the sheet. The at least one fold line demarcates the sheet into at least two support wings, so that an included angle of less than 180° is provided between two of the at least two support wings, the sheet thus having an inside surface and a corresponding outside surface.

The at least one fold line includes a pair of opposed surfaces formed from the inside surface of the sheet of material, defining a fold channel. A corner post reinforcing and retaining material is operably disposed on the sheet, within at least a portion of the fold channel at the at least one fold line, so as to reinforce and maintain the sheet in the folded configuration, by facilitating the ability of the apparatus to resist forces which would tend to deform the sheet from its folded configuration.

The apparatus is further operably configured for operable association with one or more containers, toward providing support to the one or more containers along a direction of the one or more containers which is substantially parallel to the fold line of the apparatus.

The corner post reinforcing material preferably is an adhesive material. In a preferred embodiment of the invention, the adhesive material is a hot-melt glue.

Preferably, the sheet of material has a substantially rectangular configuration, and preferably, the included angle between two of the at least two support wings is 60° to 120°.

The fold channel is preferably spontaneously formed in the sheet of material, upon folding of same. The sheet of material is, in a preferred embodiment of the invention, fabricated from corrugated paperboard material.

Alternatively, the sheet of material has a score line imposed thereon, prior to folding of same. In such an alternative embodiment, the sheet of material is fabricated from at least one of the following materials: plastic, single layer cardboard.

The present invention also comprises, in part, a process for making an apparatus for providing facilitated support for one or more containers, along a longitudinal direction thereof. Preferably, the process comprises the steps of: forming a sheet of material, having a longitudinal axis; folding the sheet of material, along at least one fold line extending substantially at least parallel to the longitudinal axis of the sheet, the at least one fold line demarcating the sheet into at least two support wings, so that an included angle of less than 180° is provided between two of the at least two support wings, the sheet thus having an inside surface and a corresponding outside surface, wherein the at least one fold line includes a pair of opposed surfaces formed from the inside surface of the sheet of material, defining a fold channel projecting inwardly from the inside surface toward the outside surface; configuring the sheet for operable association with one or more containers; operably disposing a hardenable corner post reinforcing and retaining material on the sheet, within at least a portion of the fold channel at the at least one fold line, so as to reinforce and maintain the sheet in the folded configuration, by facilitating the ability of the apparatus to resist forces which would tend to deform the sheet from its folded configuration; and holding the sheet in its folded configuration until the corner post reinforcing and retaining material has hardened.

The step of forming the sheet of material preferably further includes forming the sheet to have a substantially rectangular configuration.

The step of folding the sheet further comprises folding the sheet so that the included angle between two of the at least two support wings is 60° to 120°.

The fold channel preferably is spontaneously formed in the sheet of material, upon folding of same. In such an embodiment, the sheet of material is fabricated from corrugated paperboard material. Alternatively, the process includes the step of imposing a score line on the sheet of material, prior to folding of same. In such an embodiment, the sheet of material is fabricated from at least one of the following materials: plastic, single layer cardboard.

DETAILED DESCRIPTION OF THE INVENTION

Figure 1:
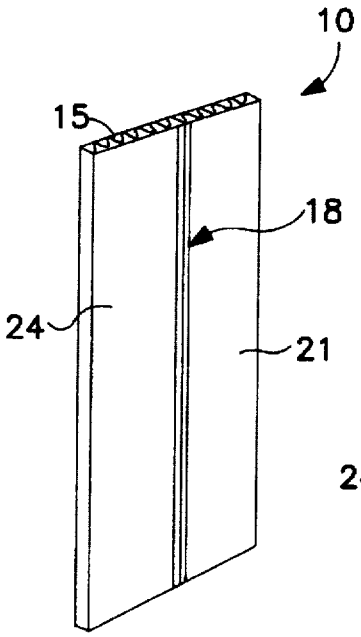
FIG. 1 is a perspective view of an unfolded sheet of material from which the corner post apparatus of the present invention will be formed.
Figure 2:
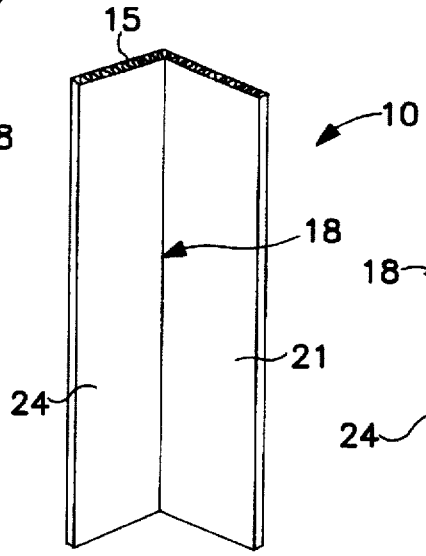
FIG. 2 is a perspective view of the folded sheet.
Figure 3:
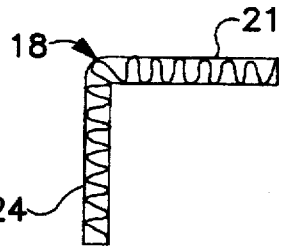
FIG. 3 is an end elevation of the sheet of material, after folding.

While this invention is susceptible of embodiment in many different forms, there is shown herein in the drawings and will be described in detail a specific embodiment, with the understanding that the present disclosure is to be considered as an exemplification of the principles of the invention and is not intended to limit the invention to the embodiment illustrated.

FIGS. 1–6 illustrate an improved corner post construction according to a preferred embodiment of the invention. Corner post 10 is provided with a configuration which is suitable for use in containers which have horizontal cross-sectional plans which are rectangular (i.e., with 90° corners). Corner post 10 includes a sheet 15 of container material, which has been folded along a longitudinal axis 18, so as to form corner post wings 21 and 24. While, in the illustrated preferred embodiment, wings 21 and 24 are symmetrically formed, it is contemplated that wings 21 and 24 may be desired to be of different overall dimensions, as the requirements of any particular application may dictate.

The process of forming corner post 10 is as follows. First, a sheet 15 of material is selected. Typically, sheet 15 will be rectangular in shape, although other configurations may be used and are contemplated as being within the scope of the present invention. Sheet 15 typically may be a single thickness of corrugated paperboard material, although for applications requiring particular longitudinal strength, double- or triple-thickness corrugated paperboard material may be used. Other materials, having similar general characteristics, such as thin plastic sheets, may also be used and still be within the scope of the invention.

Once the sheet 15 has been selected, sheet 15 is folded longitudinally. In the illustrated embodiment, sheet 15 has been folded along and parallel to longitudinal axis 18, so as to produce an outside surface 45 and an inside surface 48, generally. Sheet 15 may or may not have a crease or score line already provided along the surface where the fold is desired to occur. In the illustrated embodiment, a 90° fold has been performed, although greater or lesser folds may be provided, the included angle of course being less than 180°, and still be within the scope of the invention. The folding may be accomplished in accordance with conventional techniques and apparatus for folding such materials.

Once the folding has been performed, then adhesive 27 is applied, along the inside surface, in the crease 30 caused by the folding. The folded sheet is held at the desired angle, until the adhesive has hardened sufficiently to maintain the folded sheet at the desired angle. In a preferred embodiment, the adhesive may be any substantially hard and/or rigid setting adhesive material, such as a hot-melt glue, numerous suitable formulations of which are known in the art. A preferred brand and catalog number of adhesive would be H. B. Fuller HL7276.

Figure 5:
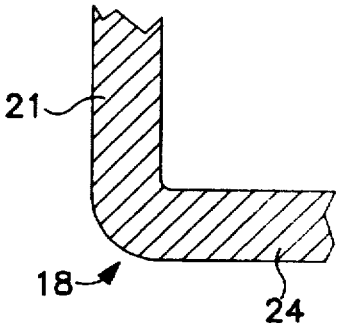
FIG. 5 is an enlarged sectional view of a folded sheet.
Figure 4:
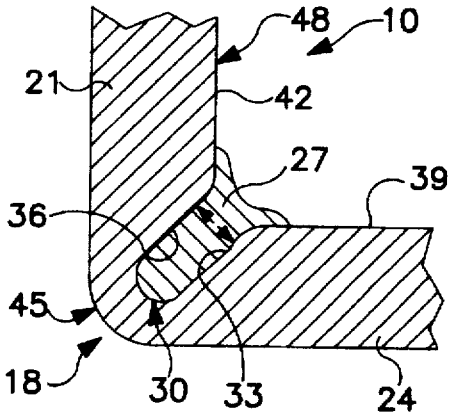
FIG. 4 is an enlarged sectional view of a folded sheet, demonstrating the behavior of corrugated paperboard, upon folding.

It has been found that when sheets of materials such as corrugated paperboard are folded, the fold, when viewed closely, does not have the structure as illustrated in FIG. 5, which shows a fold for a typical sheet of material formed from one ply of a bendable material, such as thin plastic or the like. When a sheet of material such as corrugated paperboard is folded, there is not a simple bending of the sheet into an angled form, as illustrated in FIG. 5, while the sheet retains a substantially constant thickness all through the arc of the bent region. Rather, the fold takes on the structure as illustrated in FIG. 4 (the corrugations have been omitted from FIG. 4, to simplify the illustration). The inside surface of the sheet (or the inside plies in the case of a double- or triple-thickness) tucks into the fold, toward the outside surface (or outside plies) of that sheet, forming a crease 30, in which there are two faces 33, 36.

In the case of a 90° fold, faces 33, 36 are substantially opposite one another, and may even extend parallel to one another for at least a portion of their respective depths. This behavior is believed to occur in materials like corrugated paperboard, wherein there are inside and outside skins, affixed to a core, such as corrugated material, even in the absence of a score line along the inside surface of the sheet. It is believed that since, upon folding, the inside skin cannot move transversely relative to the outside skin, the inside skin becomes compressed upon itself and the necking or crimping shown in FIG. 4 occurs.

When the adhesive 27 is placed into crease 30, the adhesive adheres to faces 33, 36, and creates a bond which resists the unfolding of sheet 15, by exerting a tensile force, as indicated by the arrows in FIG. 4. In a preferred embodiment of the invention, the adhesive is primarily positioned in the crease 30, and as little adhesive as possible is placed on faces 39, 42 of wings 24, 21, respectively, since adhesive placed there does not significantly contribute to the resistance to unbending, as does the adhesive connecting faces 33, 36, and simply adds to the cost of the structure.

The included angle between the wings can be greater or less than 90°, preferably between 60° and 120° and still be substantially maintained in the angled orientation by the adhesive 27.

Once the angle increases beyond 120°, the adhesive no longer provides significant resistance to the unfolding or flattening of the sheet. Also, as a practical matter, as the included angle between wings 21, 24 is lowered, to bring the faces 33, 36 into contact, little room remains for the adhesive 27, or to provide sufficient room for surrounding the corner of an article to be packaged.

It is believed that the folding mechanics just described occurs in corrugated paperboard, whether or not the flutes of the corrugated material extend parallel or perpendicular to the fold. Further, it is believed that the adhesive need not extend in a continuous line along the fold, but may be disposed in longitudinally extending strips, with gaps in between. When a non-continuous bead of adhesive is used, the beads of adhesive should be at least from 2 to 12 inches long, with gaps of at most 2 to 10 inches between beads of adhesive. By using intermittent beads of adhesive, the total amount of adhesive used is decreased, resulting in a further materials and cost savings.

Once the corner post 10 has been formed, it can be placed into one of the corners of a box or carton, either loosely or attached by adhesive to the inside surfaces of the corner, as desired.

Figure 6:
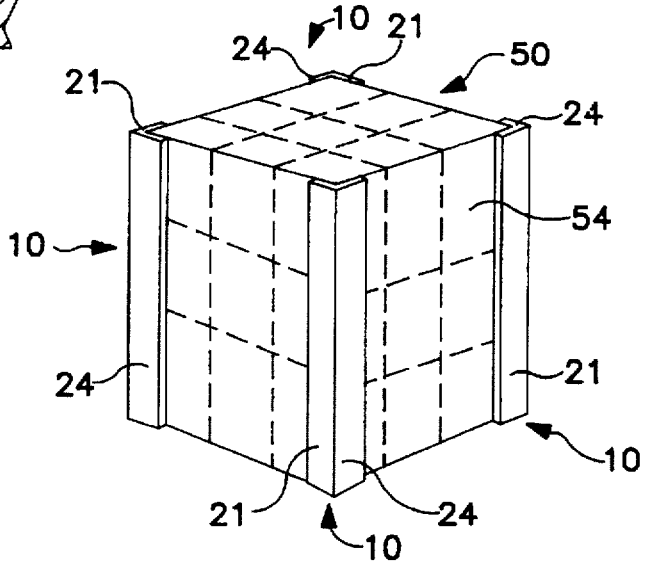
FIG. 6 is a perspective view of a plurality of finished corner post apparatus according to the present invention, illustrated in place on the corners of a unit, which may comprise one or a plurality of containers.

The corner posts 10 may also be placed on the corners of rectangular units containing one or several boxes or similar containers to keep them from shifting within the unit and/or crushing. In such a utilization, the corner posts will be held in place by wrapping the unit with a plastic stretch film. As shown in FIG. 6, a plurality of corner posts 10, each having wings 21 and 24, may be placed along four (or more) of the corners of a unit 50. Unit 50 may comprise a single right rectangular parallelpiped container. Alternatively, as indicated by the phantom lines, unit 50 may comprise a plurality of right rectangular parallelpiped containers 51. In either event, after placement of the corner posts 10, the unit 50 and corner posts 10 may be positioned within another, larger container (not shown), or may be surrounded and held together, without a further container, such as by wrapping the combined corner posts and unit with a material such as a plastic stretch film (not shown).

Of course, although the invention has been discussed in the environment of providing enhanced strength for bearing vertically directed loads in a container, the present invention can be used in non-vertically oriented applications, wherever increased resistance to crushing is desired, along a longitudinal direction, such as a horizontally extending corner in a container.

In addition, although the corner posts of the present invention have been discussed in operable association with rectangular containers or units of containers, it is contemplated that the corner posts of the present invention can be modified to be used with non-rectangular containers or units of containers, by suitably varying the included angle between the wings, as discussed elsewhere herein, and still be within the scope of the present invention.

Figure 7:
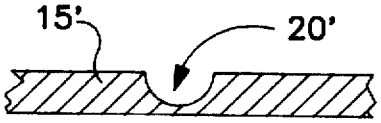
FIG. 7 is a fragmentary side elevation of a sheet of material for an alternative embodiment of the invention, wherein a score line is provided in the sheet prior to folding.

The present invention can also be used with materials, such as thin plastic sheeting and the like, in which the inside and outside surfaces do not spontaneously form a pronounced crease depression, during folding, to provide a corner post. When such materials are to be used, preferably a suitably deep score line will be preliminarily provided along the line where folding is intended to occur. FIG. 7 shows a side elevation of such an unfolded sheet 15', fabricated from such a material, in which a score line 20' has been provided. Known material scoring techniques may be employed. The sheet 15' may then be folded, and the adhesive may then be applied, and serve to exert the same tensile force, as described with respect to the previous embodiment. Alternatively, no score line may be provided, although the resistance to unfolding or flattening in such a construction would be considerably less than that provided in corner posts formed from sheets in which the pronounced crease depression is either spontaneously or intentionally formed during the folding process.

The present invention is described in the embodiment of a sheet folded into two wings, forming an "L"-shaped corner post. It can readily be observed that instead of a single fold line, two or more parallel fold lines may be provided, so that the corner post may have a plan or transverse cross-section in the form of a faceted "U" shape, or "S" or "Z" shape, as long as changes in fold directions are provided. Depending upon the strength requirements of the application, the width of the sheet and number of folds, and the included angles therebetween can be greatly varied, to provide corner posts having plan or transverse cross-sectional configurations of substantially any degree of complexity that may be desired, all being within the scope of the principles of the present invention.

The present invention is also believed to have an advantageous construction in that it may readily be formed and fabricated using automated forming equipment.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

I claim:

1. An apparatus for providing facilitated support for one or more containers, along a longitudinal direction thereof, the apparatus comprising:

a sheet of material, having a longitudinal axis;

the sheet of material being folded, along at least one fold line extending substantially parallel to the longitudinal axis of the sheet, the at least one fold line demarcating the sheet into at least two support wings, so that at an included angle of less than 180° is provided between two of the at least two support wings, the sheet thus having an inside surface and a corresponding outside surface, the at least one fold line including a pair of opposed surfaces formed from the inside surface of the sheet of material, defining a fold channel, in which the opposed inside surfaces of said sheet of material remain on each side of said fold channel, substantially unjuxtaposed to one another;

a corner post reinforcing and retaining material, operably disposed on the sheet, within at least a portion of the fold channel at the at least one fold line, so as to reinforce and maintain the sheet in the folded configuration, by facilitating the ability of the apparatus to resist forces which would tend to deform the sheet from its folded configuration, the apparatus being further operably configured for operable association with one or more containers, toward providing support to the one or more containers along a direction of the one or more containers which is substantially parallel to the fold line of the apparatus;

the sheet of material from which the corner post apparatus is fabricated further being devoid of structures for substantially juxtaposing said opposed inside surfaces to one another upon the sheet being folded.

2. The apparatus according to claim 1, wherein the corner post reinforcing material is an adhesive material.

3. The apparatus according to claim 2, wherein the adhesive material is a hot-melt glue.

4. The apparatus according to claim 1, wherein the sheet of material has a substantially rectangular configuration.

5. The apparatus according to claim 1, wherein the included angle between two of the at least two support wings is 60° to 120°.

6. The apparatus according to claim 1, wherein the fold channel is spontaneously formed in the sheet of material, upon folding of same.

7. The apparatus according to claim 1, wherein the sheet of material is fabricated from corrugated paperboard material.

8. The apparatus according to claim 1, wherein the sheet of material has a score line imposed thereon, prior to folding of same.

9. The apparatus according to claim 1, wherein the sheet of material is fabricated from at least one of the following materials: plastic, single layer cardboard.

10. A process for making an apparatus for providing facilitated support for one or more containers along a longitudinal direction thereof, the process comprising the steps of:

forming a sheet of material, having a longitudinal axis;

the sheet of material further comprising a sheet of material;

folding the sheet of material, along at least one fold line extending substantially at least parallel to the longitudinal axis of the sheet, the at least one fold line demarcating the sheet into at least two support wings, so that an included angle of less than 180° is provided between two of the at least two support wings, the sheet thus having an inside surface and a corresponding outside surface, the at least one fold line including a pair of opposed surfaces formed from the inside surface of the sheet of material, defining a fold channel projecting inwardly from the inside surface toward the outside surface, in which the opposed inside surfaces of said sheet of material remain on each side of said fold channel, substantially unjuxtaposed to one another;

configuring the sheet for operable association with one or more containers;

fabricating the sheet of material from which the corner post apparatus to be devoid of structures for substantially juxtaposing said opposed inside surfaces to one another upon the sheet being folded;

operably disposing a hardenable corner post reinforcing and retaining material on the sheet, within at least a portion of the fold channel at the at least one fold line, so as to reinforce and maintain the sheet in the folded configuration, by facilitating the ability of the apparatus to resist forces which would tend to deform the sheet from its folded configuration;

holding the sheet in its folded configuration until the corner post reinforcing and retaining material has hardened.

11. The process according to claim 10, wherein the step of forming the sheet of material further includes forming the sheet to have a substantially rectangular configuration.

12. The process according to claim 11, wherein the step of folding the sheet further comprises folding the sheet so that the included angle between two of the at least two support wings is 60° to 120°.

13. The process according to claim 11, wherein the fold channel is spontaneously formed in the sheet of material, upon folding of same.

14. The process according to claim 11, wherein the sheet of material is fabricated from corrugated paperboard material.

15. The process according to claim 11, further comprising the step of imposing a score line on the sheet of material, prior to folding of same.

16. The apparatus according to claim 11, wherein the sheet of material is fabricated from at least one of the following materials: plastic, single layer cardboard.

* * * * *